US007604549B2

(12) United States Patent
Sugimoto

(10) Patent No.: US 7,604,549 B2
(45) Date of Patent: Oct. 20, 2009

(54) GOLF CLUB HEAD

(75) Inventor: Yasushi Sugimoto, Kobe (JP)

(73) Assignee: SRI Sports Limited, Kobe (JP)

( * ) Notice: Subject to any disclaimer, the term of this patent is extended or adjusted under 35 U.S.C. 154(b) by 258 days.

(21) Appl. No.: 11/320,769

(22) Filed: Dec. 30, 2005

(65) Prior Publication Data

US 2006/0194645 A1 Aug. 31, 2006

(30) Foreign Application Priority Data

Feb. 25, 2005 (JP) ..... 2005-051454
Aug. 18, 2005 (JP) ..... 2005-237772

(51) Int. Cl.
*A63B 53/04* (2006.01)

(52) U.S. Cl. ..... 473/342; 473/350

(58) Field of Classification Search ..... 473/324–350
See application file for complete search history.

(56) References Cited

U.S. PATENT DOCUMENTS 6,506,129 B2 * 1/2003 Chen ..... 473/329
6,676,536 B1 * 1/2004 Jacobson ..... 473/329
6,709,345 B2 * 3/2004 Iwata et al. ..... 473/291
6,971,961 B2 * 12/2005 Chen ..... 473/342
2004/0185960 A1 * 9/2004 Chen ..... 473/342
2006/0073912 A1 * 4/2006 Hsieh et al. ..... 473/350

FOREIGN PATENT DOCUMENTS

JP 2004-242952 A 9/2004

* cited by examiner

*Primary Examiner*—Gene Kim
*Assistant Examiner*—Alvin A Hunter
(74) *Attorney, Agent, or Firm*—Birch, Stewart, Kolasch & Birch, LLP

(57) ABSTRACT

A golf club head comprises a face plate comprising a base portion including a front surface forming a club face for hitting a ball, a circumferential surface forming a front zone of a circumference of the club head, and a rib protruding from a back surface of the base portion backwardly and extending along the circumferential surface of the base portion so as to define a first region surrounded thereby on the back surface, and a head main body being provided with a face mount, the face mount comprising a recess holding the rib without contacting the first region.

9 Claims, 10 Drawing Sheets

GOLF CLUB HEAD

BACKGROUND OF THE INVENTION

1. Field of the Invention

The present invention relates to a golf club head which can improve a rebound performance of the head.

2. Description of the Related Art

FIG. 10 shows a cross sectional view of one example of a conventional iron-type golf club head b. The golf club head b comprises a face plate c, and head main body c including a face mount f provided around an opening o thereof. The face mount f comprises a back-support wall for supporting a periphery part e2 of a back surface of the face plate c, and side wall for supporting a circumferential surface e1 of the face plate c.

In order to improve the rebound performance of such a club head b, it is desirable to enlarge a non-supported area g with a flexibility of the face plate c.

In the conventional club head b, however, if a length Wi of a non-supported part g of the face plate c becomes large, a joint strength between the face plate c and the face mount f becomes low according to a decrease of a mount width Wc of the head main body d.

SUMMARY OF THE INVENTION

It is therefore, an object of the present invention to provide a golf club head which can improve the rebound performance without decreasing the joint strength between the face plate and head main body.

According to the present invention, a golf club head comprises a face plate having a base portion comprising a front surface forming a club face for hitting a ball and a circumferential surface comprising a front zone of a circumference of the club head, and a rib protruding from a back surface of the base portion backwardly and extending along the circumferential surface of the base portion so as to define a first region surrounded thereby on the back surface, and a head main body being provided with a face mount comprising a recess holding the rib without contacting the first region.

DESCRIPTION OF THE PREFERRED EMBODIMENT

Embodiment of the present invention will now be described in detail in conjunction with the accompanying drawings.

Figure 1:
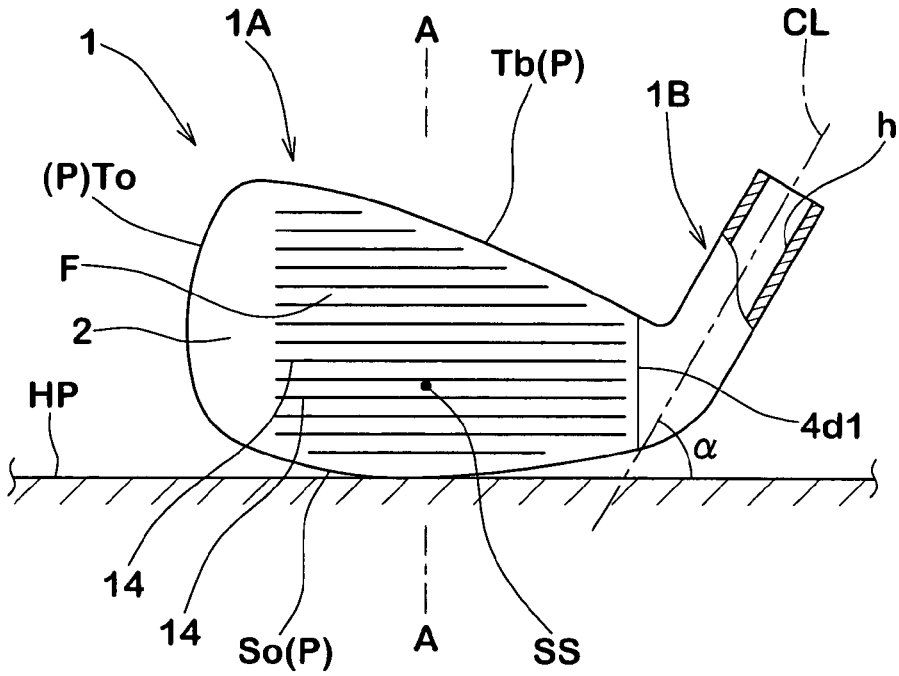
FIG. 1 is a front elevational view of a golf club head showing an embodiment in accordance with the present invention.
Figure 2:
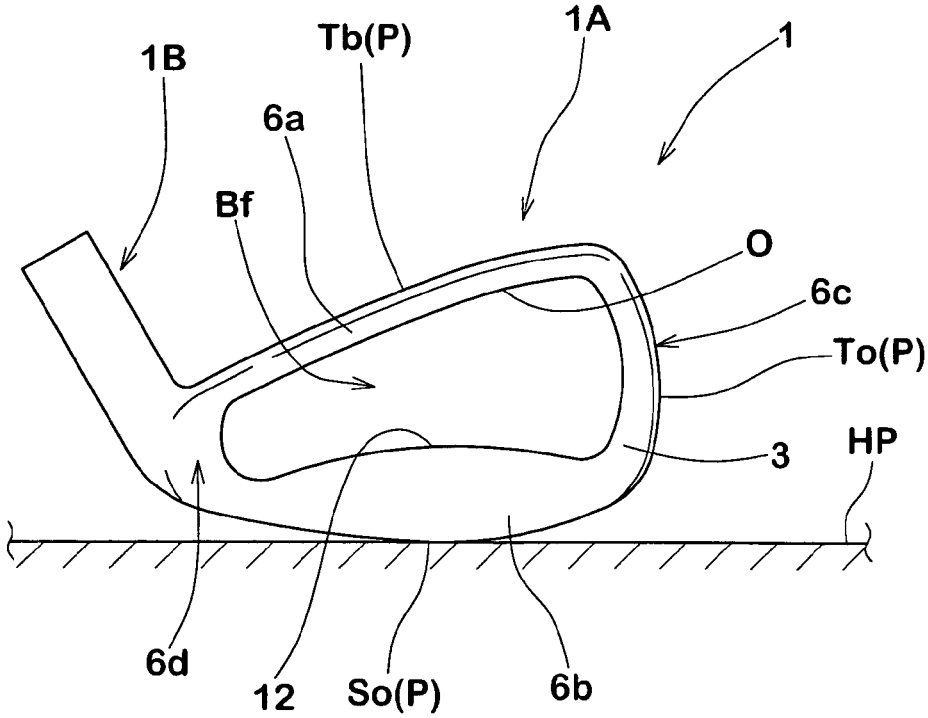
FIG. 2 is a back elevational view of FIG. 1.
Figure 3:
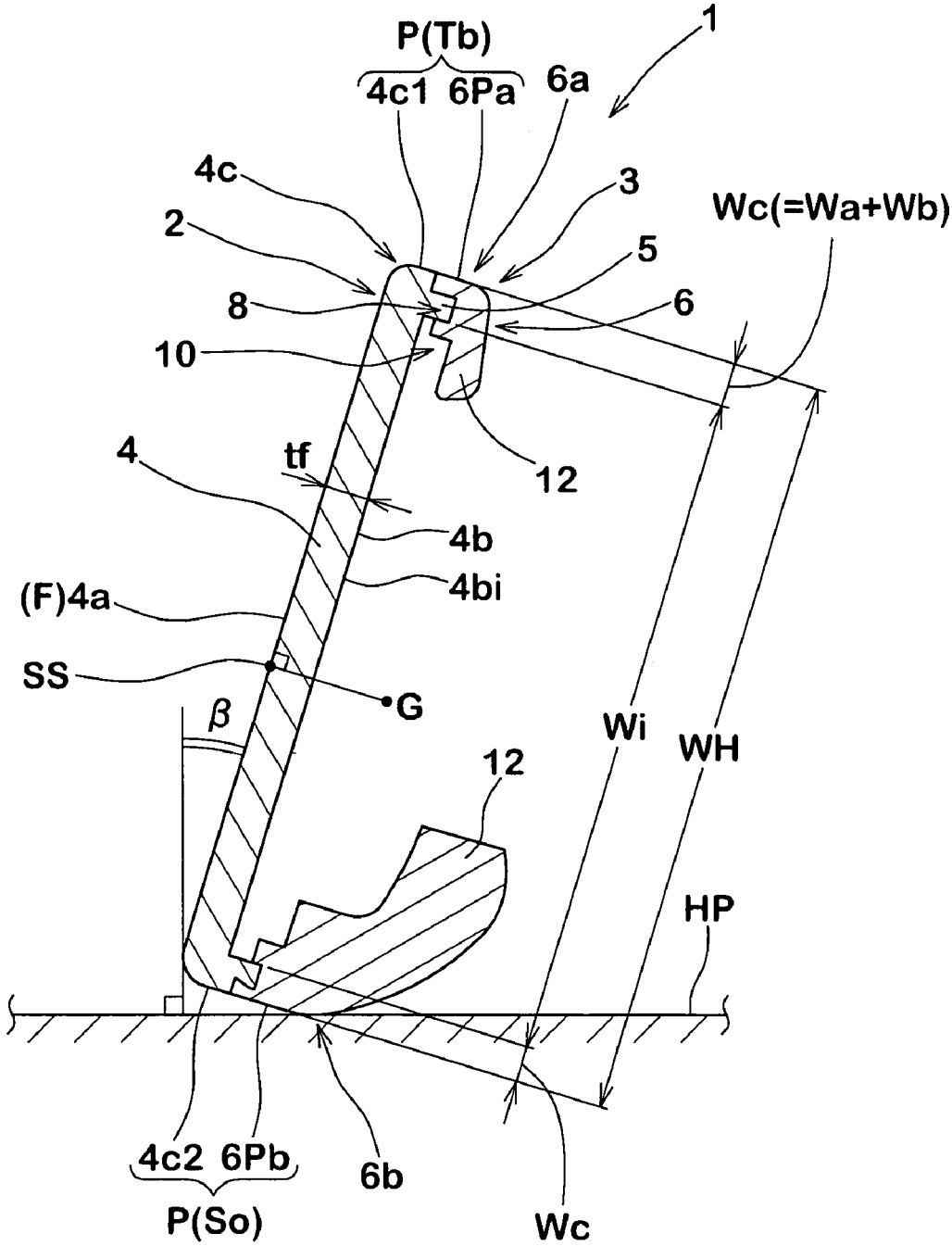
FIG. 3 is an end elevational view taken along a line A-A in FIG. 1.

FIGS. 1 to 3 show a golf club head 1 under a standard state that the club head 1 is placed on a horizontal plane HP while being kept at prescribed its lie angle alpha and its loft angle beta (shown in FIG. 3).

The club head 1 comprises an iron-type golf club head including a club head base body 1A and a hosel 1B.

The club head base body 1A includes a club face F for hitting a ball, a back face Bf in an opposite side of the club face, and a circumference P of the club head extending therebetween. The circumference P of the club head includes: a top surface Tb extending to a rear side of the club head from an upper edge of the club face F and forming an upper surface of the club head; a sole surface (So) extending to the rear side from a lower edge of the club face F and forming a lower surface of the head; and a toe surface (To) connecting between the top surface Tb and the sole surface (So).

Further, the hosel 1B is provided in a heel side of the club head base body 1A. The hosel 1B has a shaft insertion hole h to which a shaft (not shown) is installed, and an axial center line CL thereof is substantially equal to a shaft axis.

In this embodiment, the club head 1 comprises two components including a face plate 2 forming at least a part (a major part in this embodiment) of the club face F, and a head main body 3 to which the face plate 2 is attached.

Both of the face plate 2 and the head main body 3 are made of a metal material. Especially, in order to provide the head 1 in which a moment of inertia and a sweet area are large, a metal material having a specific gravity smaller than the head main body 3 is preferably used in the face plate 2.

The face plate 2 is preferably used, for example, a pure titanium, a titanium alloy, an aluminum alloy, a maraging steel, an amorphous alloy or the like. Further, the head main body 3 is preferably used, for example, a stainless steel such as SUS630, SUS255, SUS450 and the like, the maraging steel, an Ni alloy or a soft iron. A resin, a fiber reinforced resin or the like can be used in a part of the club head 1.

Figure 4:
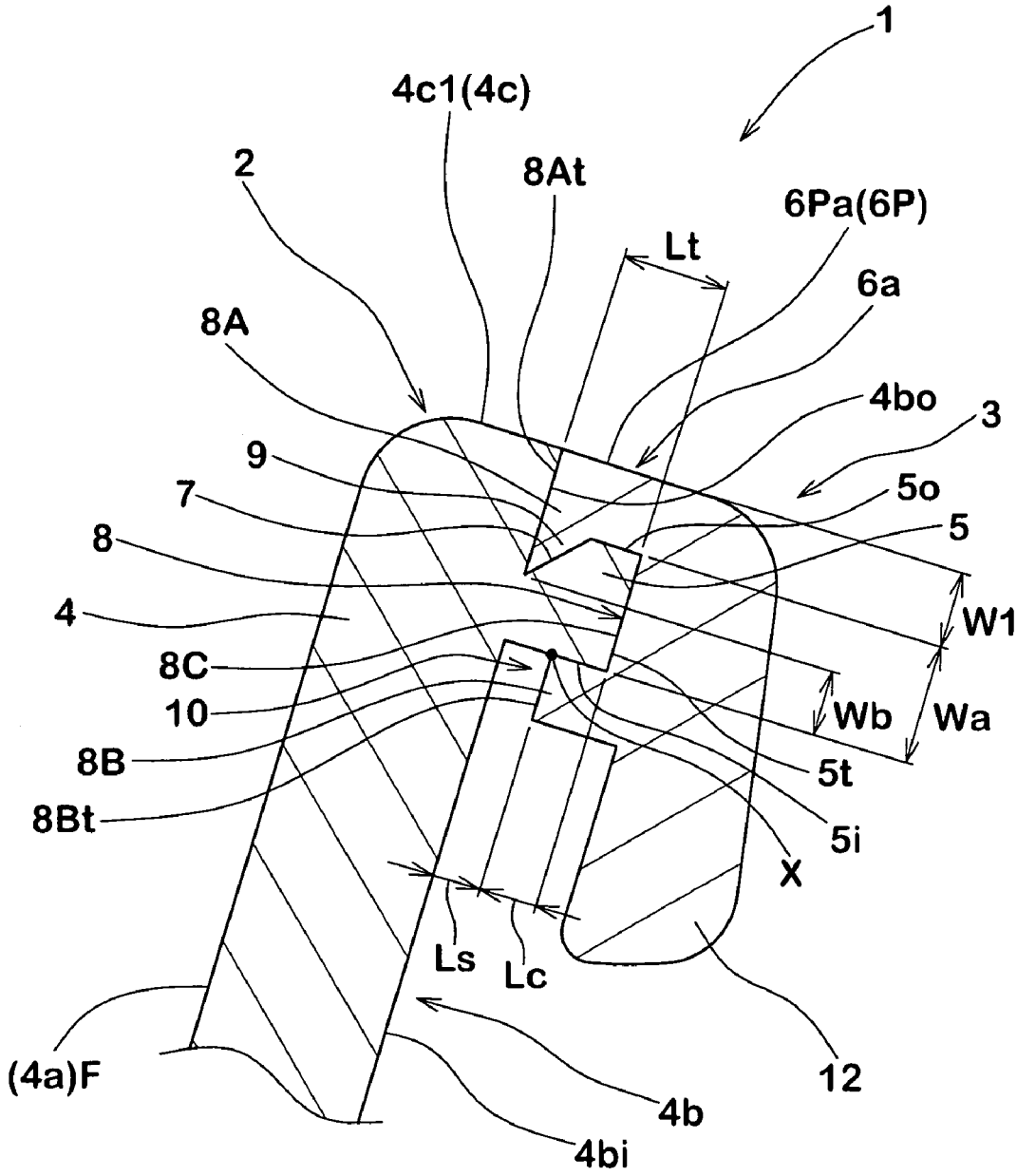
FIG. 4 is an enlarged view of a main portion in FIG. 3.
Figure 5:
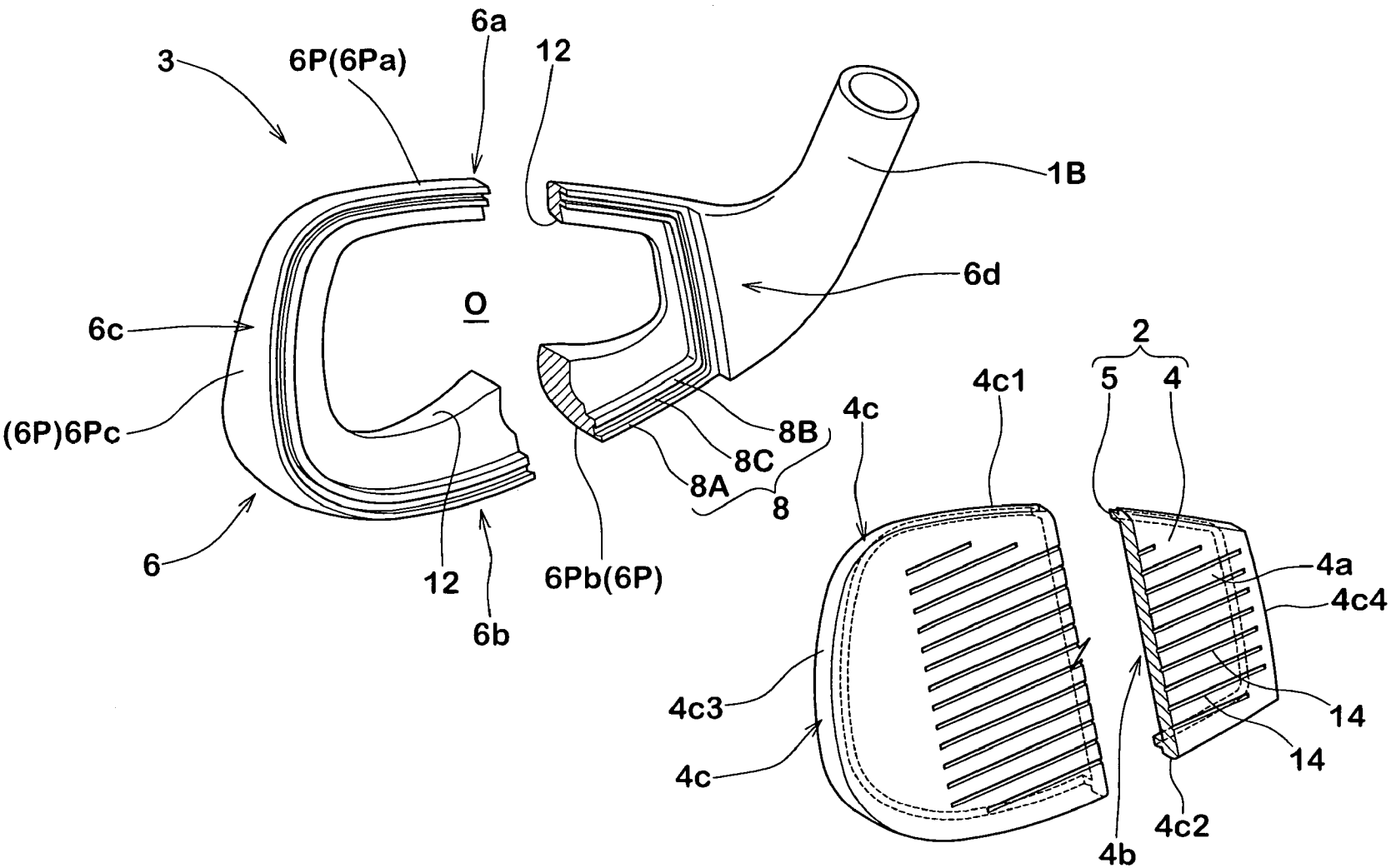
FIG. 5 is an exploded perspective view of the club head.

The face plate 2 comprises a base portion 4, and a rib 5 protruding to a rear side from a back surface 4*b* of the base portion 4, as shown in FIGS. 3 to 5.

The base portion 4 including: a front surface 4*a* forming the club face F; the back surface 4*b* in an opposite side thereto; and a circumferential surface 4*c* joining between the back surface 4*b* and the front surface 4*a* and forming at least a part of front zone of the circumference P of the club head 1.

The base portion 4 is formed substantially at a fixed thickness tf except a face line 14 on the club face F and the like. In this embodiment, the thickness tf of the base portion 4 is not particularly limited, however, in order to improve a durability and a rebound performance, it is desirable that the thickness tf is preferably set not less than 1.0 mm, more preferably not less than 1.5 mm and further preferably not less than 2.0 mm, but it is further desirable that the thickness tf is preferably set not more than 4.0 mm, more preferably not more than 3.5 mm and further preferably not more than 3.0 mm. Further, the base portion 4 may be formed in such a manner as to have a thin peripheral portion and a thick center portion.

Further, the circumferential surface 4*c* of the base portion 4 includes: a top side surface 4*c*1 forming the front zone of the top surface Tb; a sole side surface 4*c*2 forming the front zone of the sole surface (So); a toe side surface 4*c*3 forming the front zone of the toe surface (To); and a heel side surface 4*c*4 joining between the top side surface 4*c*1 and the sole side surface 4*c*3 in the heel side. The face plate 2 mentioned above can form a major part (approximately entire region) of the face F. The heel side surface 4*c*4 is disconnected short of the hosel 1B, and is covered with the head main body 3.

The rib 5 protrudes backwardly of the club head 1 from the back surface 4*b* of the base portion 4, as shown in FIGS. 4 and 5, and extends along the circumferential surface 4*c* of the base portion 4. The rib 5 in accordance with the present embodiment is provided at a position which is apart from the circumferential surface 4*c* of the base portion 4 to a center side of the club face at a distance W1, and continuously extends annularly along the circumferential surface 4*c*. Accordingly, a first region 4*bi* surrounded by the rib 5 and a second region 4*bo* between the rib 5 and the circumferential surface 4*c* of the base portion 4 are zoned on the back surface 4*b*. In this case, FIG. 3 is a vertical cross sectional view of the club head perpendicular to the club face F passing through a sweet spot SS in the standard condition mentioned above.

The rib 5 is structured such that a cross section thereof is formed approximately in a rectangular shape, and a notch 7 is provided in a root side thereof. The notch 7 is formed approximately in a triangular cross sectional shape reducing a thickness of the rib 5, and extends along the outer peripheral surface 4*c*. Accordingly, the rib 5 has a maximum thickness Wa in a rear side, and has a portion with a thickness Wb smaller than the thickness Wa in a root side. Further, the cross sectional shape of the notch 7 is not limited to the illustrated aspect. An operation and the like of the notch portion 7 will be described later.

The head main body 3 comprises: one opening (O) penetrating in a front-back direction of the club head; a face mount 6 formed around the opening (O) and having an circumferential surface 6P forming a back zone of the circumference P of the club head 1; and the hosel 1B continuously provided in the heed side, as shown in FIGS. 3 to 5.

The face mount 6 includes: a top side rim 6*a* having a top side surface 6Pa forming a back zone of the top surface Tb and extending in a toe-heel direction of the club head; a sole side rim 6*b* having a sole side surface 6Pb forming a back zone of the sole surface (So); a toe side rim 6*c* having a toe side surface 6Pc forming a back zone of the toe surface (To) and joining the top side rim 6*a* and the sole side rim 6*b*; and a neck portion 6*d* joining the top side rim 6*a* and the sole side rim 6*b* in the heel side.

The opening (O) provides a space in which the face plate 2 can freely bend backwardly at a time of hitting the ball. Accordingly, a great bending of the face plate 2 is secured. In this case, the head main body 3 may be structured by a hollow type that a back wall portion (not shown) which is not brought into contact with the base portion 4 of the face plate 2 is provided in place of the penetrating opening portion O.

Further, the face mount 6 is provided with a recess 8 holding the rib 5 without being in contact with the first region 4*bi* of the face plate 2.

As shown in FIG. 4, the recess 8 comprises a groove shape having an outer wall portion 8A and an inner wall portion 8B respectively pinching the rib 5 from the second region 4*bo* side and the first region 4*bi* side, and a bottom 8C provided therebetween.

The outer wall portion 8A continuously extends annularly while being in contact with an outer surface 5*o* of the rib 5, as shown in FIGS. 4 and 5. Further, the outer wall portion 8A is provided with an engagement portion 9 entering into the notch 7 so as to hold the face plate 2 while preventing the face plate 2 from coming off.

The engagement portion 9 is formed, for example, in accordance with the following steps.

Figure 6:
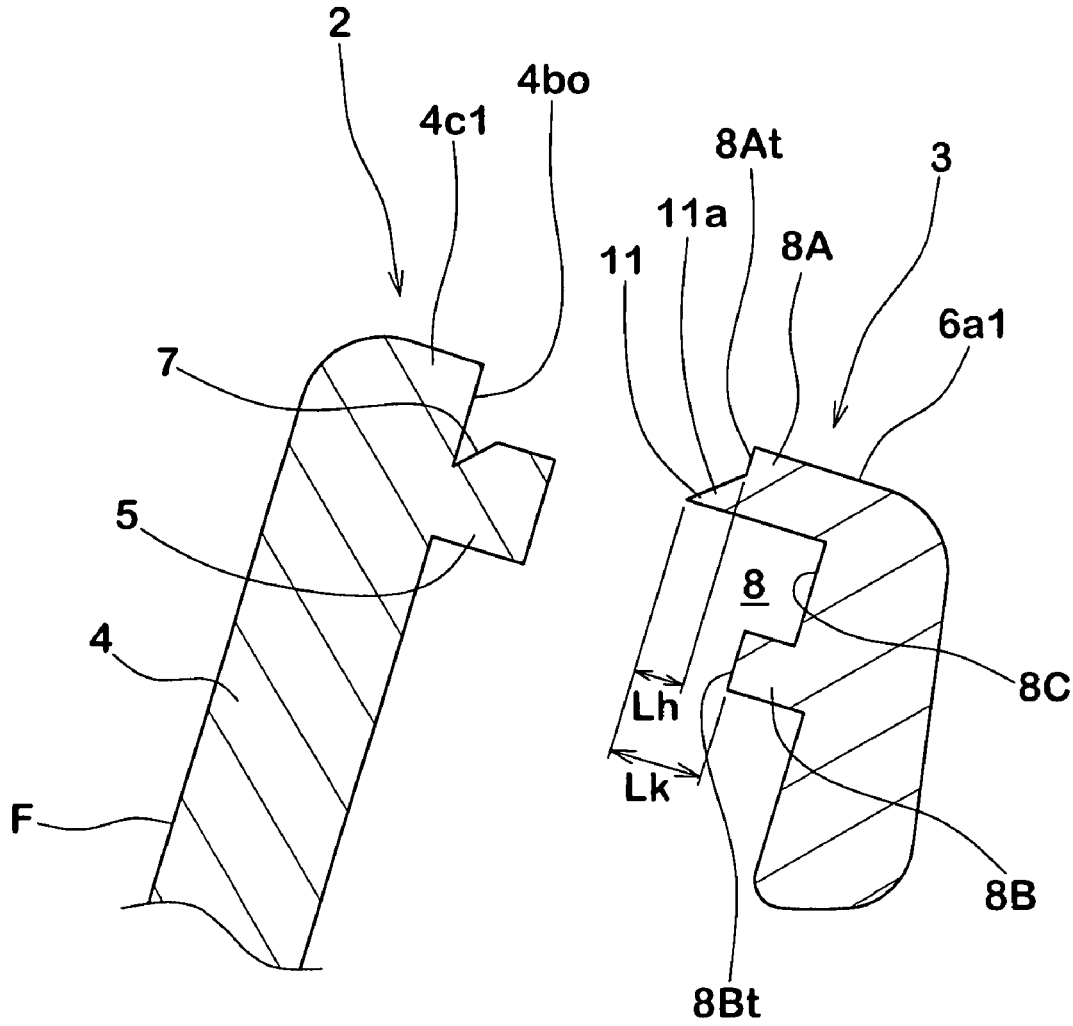
FIG. 6 is an exploded cross sectional view of the club head.

First, as shown in FIG. 6, the head main body 3 has a taper-shaped protrusion 11 being previously provided in a front end 8At of the outer wall portion 8A. The protrusion 11 is provided near the rib 5, and is constituted by a taper surface 11*a* in which an outer side is inclined.

Next, the rib 5 of the face plate 2 is inserted to the recess 8, and both the components are temporarily assembled. At this time, the protrusion 11 increases a length of the outer wall portion 8A, and serves for securely holding the rib 5.

Next, both the components 2 and 3 are pressed to each other in accordance with a press or the like. Accordingly, the protrusion 11 is strongly pressed to the second region 4*bo* of the base portion 4 so as to be plastically deformed. At this time, the protrusion 11 enters into the notch 7 provided in the outer surface 5*o* of the rib 5 on the basis of an operation of the taper surface 11*a*. Accordingly, the engagement portion 9 is formed in the outer wall portion 8A. At a time of the pressing mentioned above, an adhesive agent may be used together. An outer appearance of the plastically deformed portion is not generally good, however, since the engagement portion 9 does not appear in an outer portion of the club head 1, the beauty of the head is maintained.

In order to securely form the engagement portion as mentioned above, it is desirable that the protruding length Lh of the protrusion 11 is preferably not less than 0.3 mm, and more preferably not less than 0.5 mm, and it is desirable that an upper limit thereof is preferably not more than 1.5 mm, and more preferably not more than 1.0 mm.

Further, in order to further smoothen the temporary assembly, as shown in FIG. 6, it is desirable that a distance Lk in a perpendicular direction to the face F between a front end 8Bt of the inner wall portion 8B and a leading end of the protrusion 11 is preferably not less than 0.5 mm, and more preferably not less than 1.0 mm, but it is desirable that an upper limit thereof is preferably not more than 2.5 mm, and more preferably not more than 2.0 mm.

The inner wall portion 8B continuously extends annularly while being in contact with the inner surface 5*i* of the rib 5. Further, a gap 10 is provided between the front end 8Bt of the inner wall portion 8B and the first region 4*bi* of the base portion 4. In this embodiment, the front end 8Bt of the inner wall portion 8B is formed by a plane which is approximately in parallel to the surface of the first region 4*bi*.

The gap 10 provides a space in which the first region 4*bi* of the base portion 4 can freely bending backwardly at a time of hitting the ball. Accordingly, the large first region 4*bi* which is not brought into contact with the head main body 3 is formed in the large face plate 2. Therefore, in the club head 1 in accordance with the present embodiment, the face plate 2 can bend largely at a time of hitting the ball, and it is possible to obtain an improvement of a rebound performance and a long carry.

In order to securely prevent the contact between the first region 4*bi* and the front end 8Bt of the inner wall portion 8B and improve a bonding strength, it is desirable that a length Ls of the gap 10 (measured in the perpendicular direction to the club face F) is preferably not less than 50 micron, more preferably not less than 0.7 mm, and further preferably not less than 1.0 mm, but it is preferably not more than 3.0 mm, more preferably not more than 2.0 mm, and further preferably not more than 1.5 mm.

Further, in order to obtain a sufficient engagement effect with the rib 5 and achieve a weight saving, it is desirable that a contact length Lc between the inner wall portion 8B and the inner surface 5*i* of the rib 5 is preferably set not less than 0.5 mm, more preferably not less than 1.0 mm, and further preferably not less than 1.5 mm, but it is preferably set not more than 4.0 mm, more preferably not more than 3.0 mm, and further preferably not more than 2.5 mm.

Further, in order to obtain a larger bonding strength between the face plate 2 and the head main body 3, it is desirable that a height Lt of the rib 5 measured in the perpendicular direction to the face F (corresponding to a contact length with the club face F between the outer wall portion 8A and the outer peripheral surface 5*o* of the rib 5 in this embodiment) is preferably set not less than 1.0 mm, more preferably not less than 1.5 mm, and further preferably not less than 2.0 mm, but it is preferably set not more than 5.0 mm, more preferably not more than 4.0 mm, and further preferably not more than 3.0 mm.

Further, if a distance W1 from the circumferential surface 4*c* of the base portion 4 to the rib 5 is too small, there is a risk that the outer wall portion 8A of the recess 8 becomes thin and a strength of the engagement portion 9 is lowered. Accordingly, it is desirable that the distance W1 is preferably set not less than 1.0 mm, and more preferably not less than 2.0 mm. On the other hand, if the distance W1 is too large, there is a risk that an area of the first region 4*bi* of the base portion 4 is lowered so as to deteriorate the rebound performance. Accordingly, it is desirable that the distance W1 is preferably set not more than 4.0 mm, and more preferably not more than 3.5 mm.

Further, it is desirable that the maximum thickness Wa of the rib 5 is preferably set not less than 1.0 mm, more preferably not less than 1.5 mm, and further preferably not less than 2.0 mm, but it is preferably set not more than 4.0 mm, more preferably not more than 3.5 mm, and further preferably not more than 3.0 mm.

Further, after press inserting both the components 2 and 3, the front end 8At of the outer wall portion 8A is brought into close contact with the second region 4*bo* of the base portion 4, and the rear end surface 5*t* of the rib 5 is brought into contact with the bottom 8C of the recess 8. accordingly, the backward force applied to the face plate 2 at a time of hitting the ball is sufficiently held by the head main body 3 via the front end 8At of the outer wall portion 8A and the bottom 8C, whereby a durability of the recess 8 can be maintained.

Figure 9:
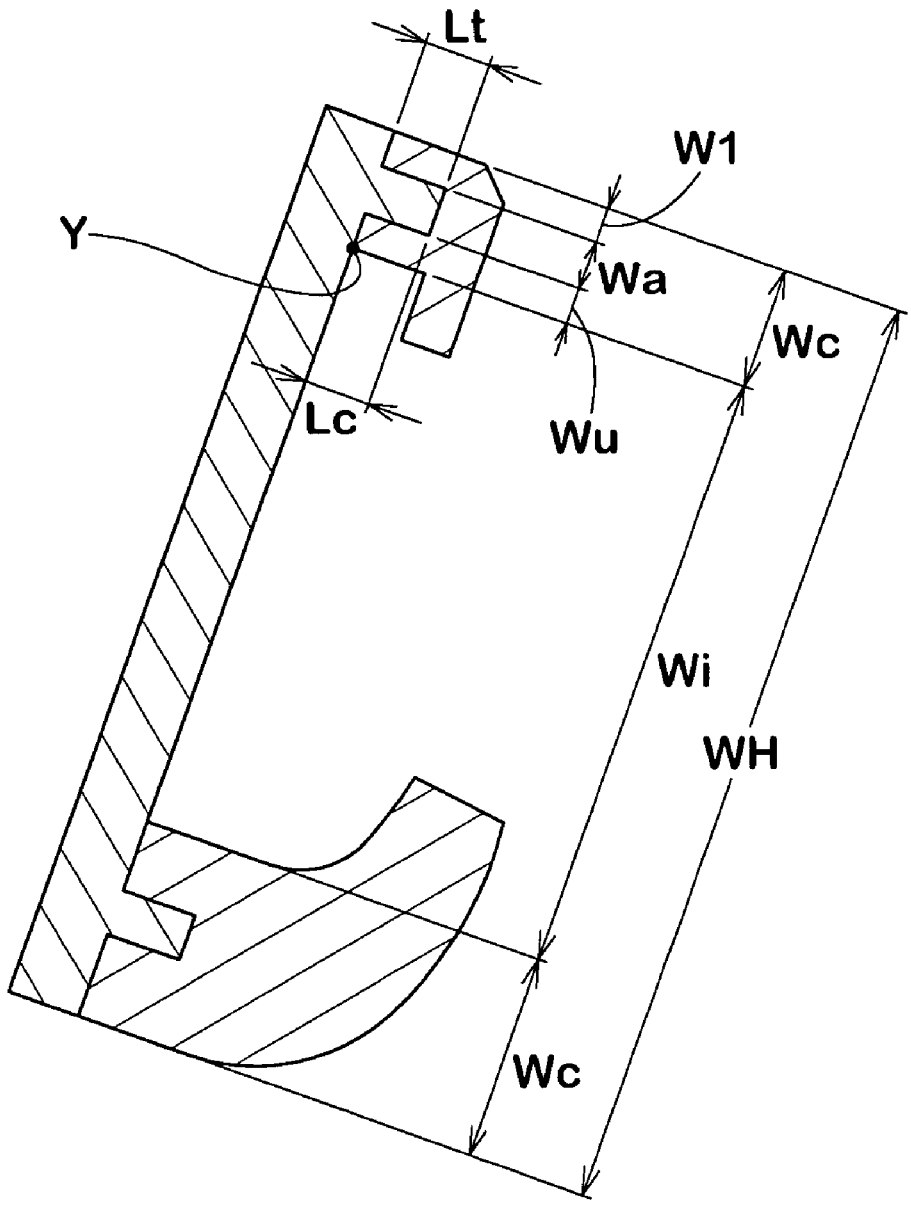
FIG. 9 is a cross sectional view of a club head in accordance with a reference.

Further, the club head shown in FIG. 9 is not preferable because a great force in a direction of being pulled out of the recess is generated in the rib around a contact point Y corresponding to a supporting point. In the club head 1 in accordance with the present embodiment, as shown in FIG. 4, since a nodal point X between the front end 8*bt* of the inner wall portion 8B and the inner surface 5*i* of the rib 5 forms a supporting point, and the rib 5 generates a stress in a direction along the face F, a bonding strength is large.

Further, in order to securely improve the rebound performance and the durability, in a vertical cross section in FIG. 3, it is desirable that a length Wi of the first region 4*bi* along the face F is preferably set not less than 35 mm, more preferably not less than 38 mm, and further preferably not less than 40 mm, but it is preferably set not more than 50 mm, more preferably not more than 48 mm, and further preferably not more than 45 mm.

Further, it is desirable that a ratio (Wi/WH) between the length Wi and a maximum length WH of the head parallel to the face F in the cross section mentioned above is preferably not less than 0.70, and more preferably not less than 0.80, and it is desirable that an upper limit thereof is preferably not more than 0.95, and more preferably not more than 0.90.

Further, the face mount 6 is provided with a return portion 12 extending toward an inner side from the recess 8. The return portion 12 is not brought into contact with the first region 4*bi* of the face plate 2 both at a time of standstill and at a time of hitting the ball. The return portion 12 is effective for concentrating much weight to the circumference P side, increasing the sweet area and the moment of inertia and regulating the club head gravity point G lower.

Figure 7:
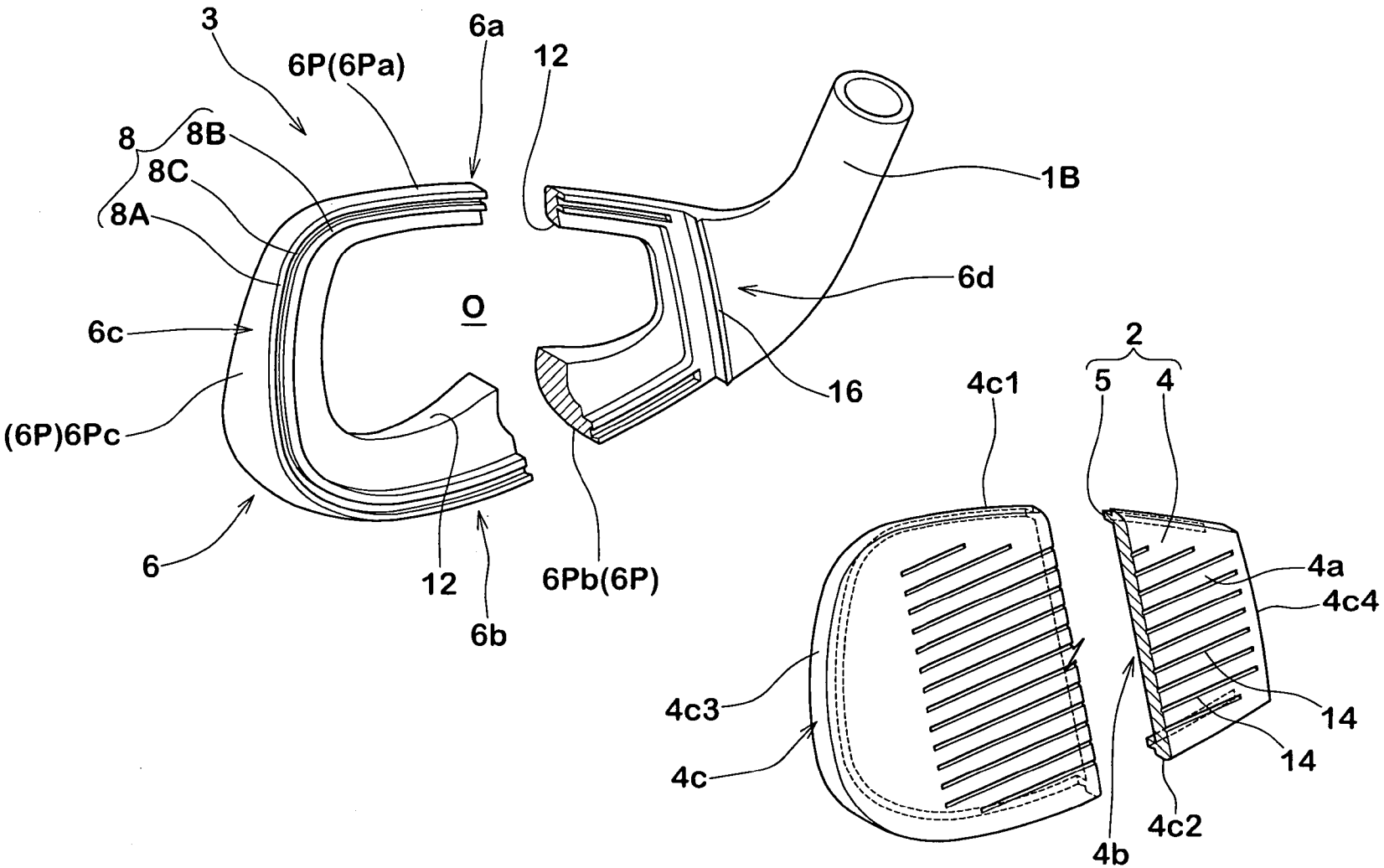
FIG. 7 is an exploded perspective view of the club head showing the other embodiment.

In the club head 1 in accordance with the embodiment, the recess 8 is continuously provided annularly, however, the club head 1 is not limited to the aspect mentioned above. A contributing ratio relating to the improvement of the rebound performance is comparatively small particularly in the heel side. Accordingly, for example, as shown in FIG. 7, it is not necessary that the recess 8 mentioned above is provided in the heel side. At this time, the heel side can be fixed, for example, by plastically deforming the pressed portion 16 provided in the head main body 3 so as to cover the front surface 2*a* of the face plate 2.

Figure 12:
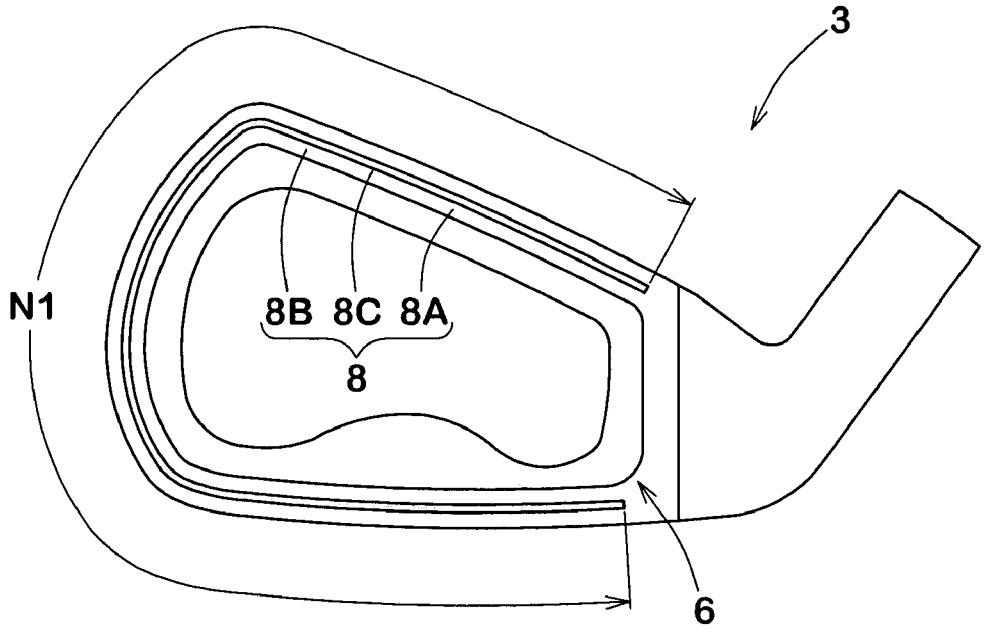
FIG. 12 is a front elevational view of a head main body describing each of lengths N1 and N2.

Accordingly, the recess 8 may be provided in a part or an entire of the top side rim 6*a*, the sole side rim 6*b* and/or the toe side rim 6*c* of the face mount 6. In this case, as shown in FIG. 12, it is desirable that a ratio (N1/N2) between a length N1 (mm) obtained by projecting the recess 8 onto the circumferential surface 4*c* of the face plate 2, and a length N2 (mm) of the circumferential surface 4*c* of the face plate 2 is preferably set not less than 0.5, and more preferably not less than 0.6. Further, in the case that the recess 8 is not provided in the heel portion, the ratio (N1/N2) is preferably not more than 0.9, more preferably not more than 0.8, and further preferably not more than 0.7.

FIG. 8 shows a cross sectional view of a main portion of the club head 1 as the other embodiment in accordance with the present invention.

Figure 8A:
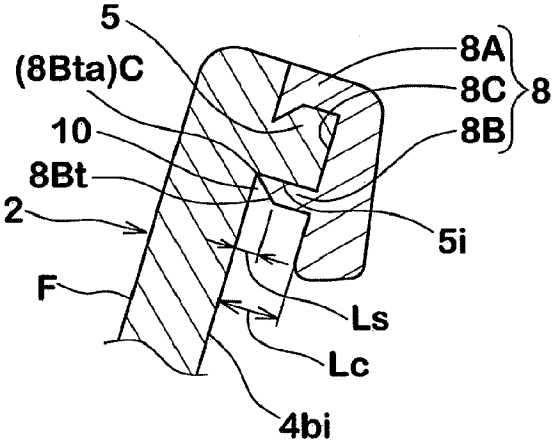
FIGS. 8A to 8E are cross sectional views of a main portion of the club head showing the other embodiment in accordance with the present invention.

In accordance with an aspect in FIG. 8A, the front end 8Bt of the inner wall portion 8B is processed in a taper shape. Further, a sharp end 8Bta thereof is brought into contact only with a corner edge C between the inner surface 5*i* of the rib 5 and the first region 4*bi*. In accordance with the aspect mentioned above, since the contact length Lc between the inner wall portion 8B and the rib 5 is secured maximum, the engagement force between the face plate 2 and the head main body 3 is large. Further, it is possible to form the recess 8 which is not substantially brought into contact with the first region 4*bi*. Accordingly, the rebound performance is further improved while improving the connecting strength between the face plate 2 and the head main body 3.

Figure 8B:
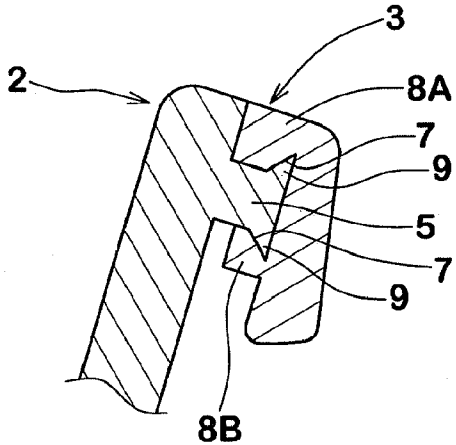

In accordance with an aspect in FIG. 8B, the notch 7 can be provided in the outer wall portion 8A and/or the inner wall portion 8B, and the engagement portion 9 is provided in the rib 5. The engagement portion 9 mentioned above is formed by forming a sharp projection (not shown) in the leading end portion 5*t* of the rib 5, and plastically deforming the projection so as to enter into the notches 7.

Figure 8C:
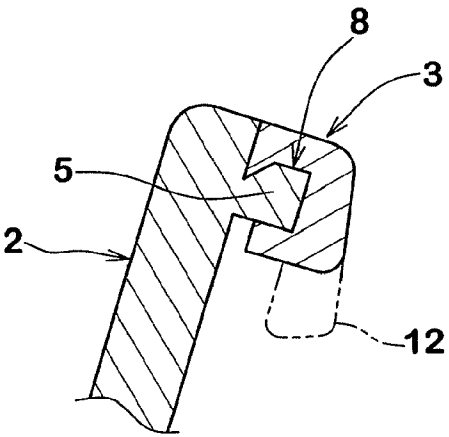

In accordance with an aspect in FIG. 8C, the extension portion 12 is removed in the top side rim. The aspect mentioned above serves for setting the center G of gravity of the club head 1 lower.

Figure 8D:
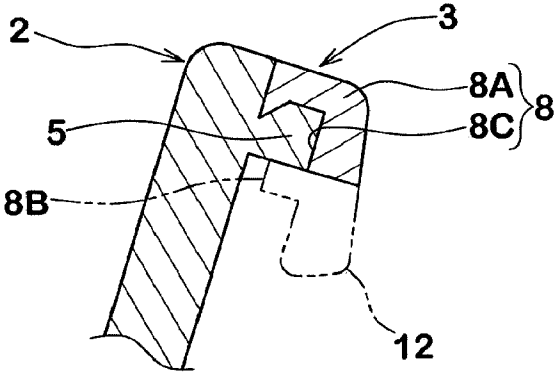

Further, in accordance with an aspect in FIG. 8D, in order to intend to achieve a lower center G of gravity of the club head 1, there is exemplified a structure in which the recess 8 is constituted by the outer wall portion 8A and the bottom 8C in the top side rim, and the inner wall portion 8B is not included.

Figure 8E:
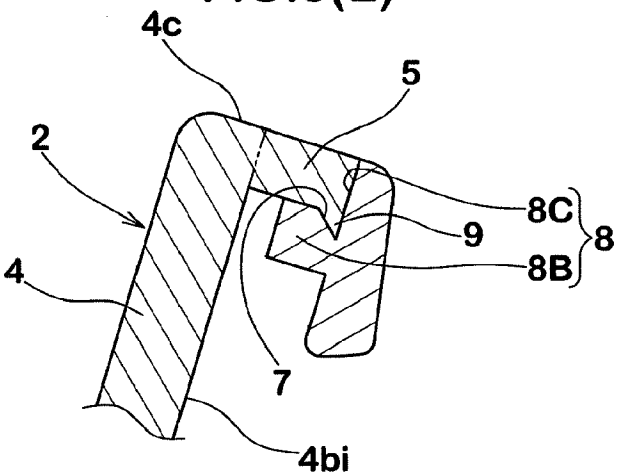

In accordance with an aspect in FIG. 8E, the rib 5 is provided without keeping a distance from the circumferential surface 4*c* of the base portion 4. In accordance with the aspect, the recess 8 is structured only by the bottom 8C and the inner wall portion 8B. The notch 7 is provided in the inner wall portion 8B, and the engagement portion 9 of the rib 5 is engaged with the notch 7. Since the aspect mentioned above can form the larger first region 4*bi* which is not brought into contact with the head main body 3, the rebound performance of the head can be further improved.

The description will be given above of the embodiments in accordance with the present invention, however, the present invention is not limited to the embodiments mentioned above, but can be modified by being changed in various aspects. For example, the face plate 2 and the head main body 3 can employ a pressure insertion mainly utilizing an elastic deformation, an adhesive bonding, a screw fastening and the like, in addition to a so-called caulking joint method utilizing one and/or the other plastic deformation.

embodiment 3. In this case, a relation Lk=1.5 mm, and Lh=0.7 mm is established. The test method is as follows.

Rebound Performance Test

The rebound performance of the club head is obtained by calculating the repulsion coefficient on the basis of Procedure for Measuring the velocity Ratio of a Club Head for Conformance to Rule 4-1e, Revision 2 (Feb. 8, 1999) in USGA.

Durability Test

An iron type golf club having an entire length of 38 inch was manufactured by way of trial by fitting a shaft made of the fiber reinforcing resin (MP-300, Flex R manufactured by SRI sports Ltd.) to each of the test heads. Next, each of the test clubs was attached to a swing robot (manufactured by Miyamae company), and was regulated such that a head speed becomes 40 m/s, and 3000 of golf balls ("everio" manufactured by SRI sports company) are hit by each of the test clubs. Further, a state of the joint portion between the face plate and the head main body is visually checked per 100 balls.

Results of the test and the like are shown in Table 1.

TABLE 1

Figure 10:
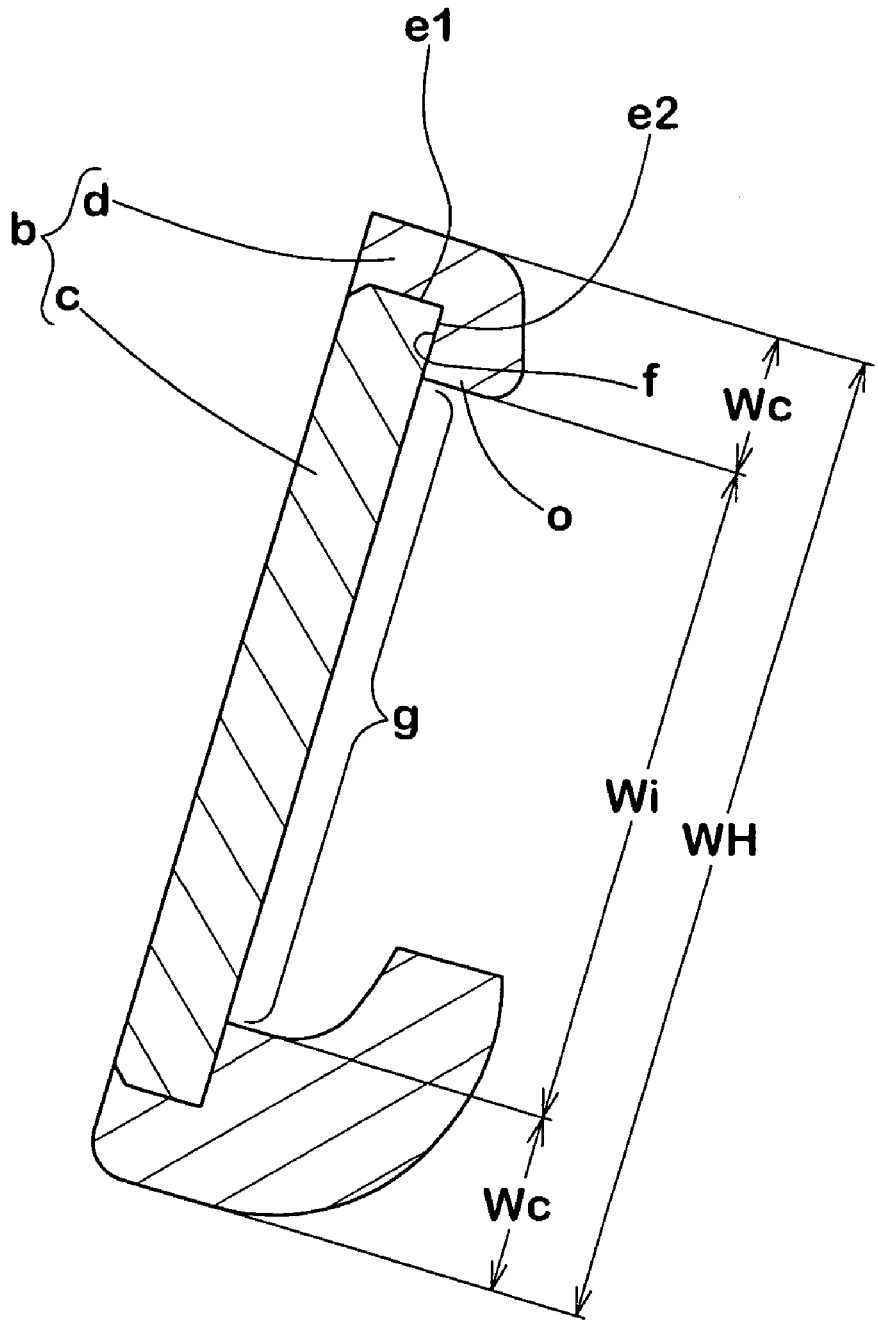
FIG. 10 is a cross sectional view of a conventional club head.
Figure 11:
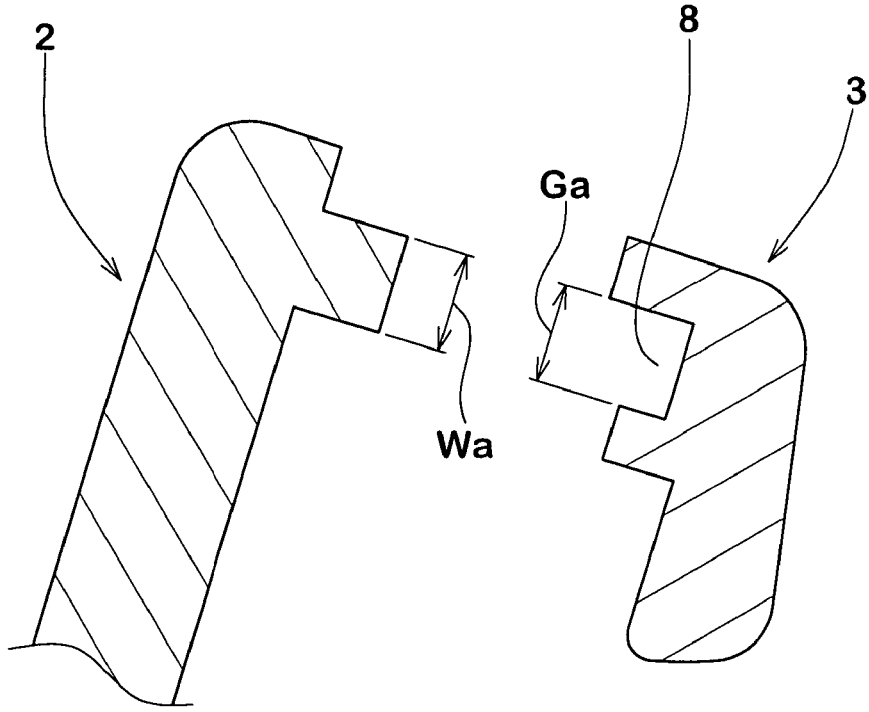
FIG. 11 is an exploded cross sectional view of the head showing the other embodiment in accordance with the present invention.

| | Ref. 1 | Ref. 2 | Ref. 3 | Ref. 4 | Ex.1 | Ex.2 | Ex.3 |
|---|---|---|---|---|---|---|---|
| Arranged Position of Recess | None | None | None | None | Top side rim Sole side rim Toe side rim | Top side rim Sole side rim — | Top side rim Sole side rim Toe side rim |
| Drawing that shows the structure | FIG. 10 | | FIG. 9 | | FIGS. 3 and 11 | | FIGS. 3 and 6 |
| Dimensional Values | | | | | | | |
| Wi (mm) | 33 | 39 | 33 | 39 | 39 | 39 | 39 |
| WH (mm) | | | | 47 | | | |
| Wc (mm) | 7 | 4 | 7 | 4 | 4 | 4 | 4 |
| W1 (mm) | — | — | 2.0 | 1.5 | 2.0 | 2.0 | 2.0 |
| Wa (mm) | — | — | 2.0 | 1.5 | 2.0 | 2.0 | 2.0 |
| Lt (mm) | — | — | 3.0 | 3.0 | 3.0 | 3.0 | 3.0 |
| Lc (mm) | — | — | 3.0 | 3.0 | 2.0 | 2.0 | 2.0 |
| Ls (mm) | — | — | 0 | 0 | 1.0 | 1.0 | 1.0 |
| Wu (mm) | — | — | 3.0 | 1.0 | — | — | — |
| N1 (mm) | — | — | — | — | 185 | 125 | 185 |
| N2 (mm) | — | — | — | — | 220 | 220 | 220 |
| ratio (N1/N2) | — | — | — | — | 0.8 | 0.6 | 0.8 |
| Rebound Performance | 0.780 | 0.805 | 0.781 | 0.804 | 0.805 | 0.803 | 0.804 |
| Durability | No damage | Joint portion was broken by 900 hits | No damage | Joint portion was broken by 1600 hits | No damage | No damage | No damage |

Comparison Test:

In order to confirm the effect of the present invention, plural kinds of iron-type golf heads (5-iron, real loft angle 24 degrees) were manufactured on the basis of the specification in Table 1, and a rebound performance and a durability were tested.

Each of the head main bodies was used a precision casting product of lost wax of SUS630, and each of the face plates was used a plate material of Ti-6Al-4V. Then, the iron-type golf club head was manufactured by pressure inserting the face plate to the head main body. A thickness of the base portion of the face plate is unified to 3.0 mm. Further, in each of the aspects, as shown in FIG. 11, the pressure insertion is executed by setting a difference (Wa−Ga) between the maximum thickness Wa of the rib and the thickness Ga of the recess 8 to 50 micron. In this case, the notch and the engagement portion shown in FIG. 6 were provided only in the

The invention claimed is:

1. An iron-type golf club head comprising a face plate comprising a base portion including a front surface forming a club face for hitting a ball and a circumferential surface forming a front zone of a circumference of the club head, a rib with an outer surface and an inner surface protruding from a back surface of the base portion backwardly and extending along the circumferential surface of the base portion so as to define a first region surrounded thereby on the back surface, the outer surface of the rib being spaced inwardly from the circumferential surface of the base portion so as to define a second region between the outer surface of the rib and circumferential surface of the base portion, and the inner surface of the rib intersecting the first region to form a corner edge, and a head main body being provided with a face mount, the face mount comprising a recess holding the rib without contacting the first region, the recess comprising an outer wall portion contacting the outer surface of the rib, an inner wall portion contacting the inner surface of the rib and a bottom between the outer wall and inner wall portions, a gap is provided between the inner wall portion and the first region on the back surface of the base portion, and the inner wall portion of the recess having a tapered shape with a sharp end confronting the corner edge without contacting the first region.

2. The golf club head according to claim 1, wherein the circumference of the club head comprises a top surface, a sole surface and a toe surface connecting between the top and sole surfaces, and the circumferential surface of the base portion comprises each part of the top surface, the sole surface and the toe surface.

3. The golf club head according to claim 2, wherein the head main body comprises an opening surrounded by the face mount of the head main body, and the face mount comprises a top side rim comprising a part of the top surface, a sole side rim comprising a part of the sole surface and a toe side rim comprising a part of the toe surface.

4. The golf club head according to claim 1, wherein the outer wall portion engages and supports the second region on the back surface of the base portion of the face plate.

5. The golf club head according to claim 1, wherein the gap has a length of 50 micron to 3.0 mm.

6. The golf club head according to claim 1, wherein a contacting length between the inner wall portion and the rib of the face plate is 0.5 to 4.0 mm, in a vertical cross section perpendicular to the club face including a sweet spot on the club face.

7. The golf club head according to claim 1, wherein a length of the first region is 35 to 50 mm, in a vertical cross section perpendicular to the club face including a sweet spot on the club face.

8. A golf club head comprising a face plate comprising a base portion including a front surface forming a club face for hitting a ball and a circumferential surface forming a front zone of a circumference of the club head, and a rib with an outer surface and an inner surface protruding from a back surface of the base portion backwardly and extending along the circumferential surface of the base portion so as to define a first region surrounded thereby on the back surface, the inner surface of the rib intersecting the first region to form a corner edge, and a head main body being provided with a face mount, the face mount comprising a recess holding the rib without contacting the first region, the recess comprising an inner wall portion contacting the inner surface of the rib, and the inner wall portion having a tapered shape with a sharp end confronting the corner edge without contacting the first region.

9. The golf club head according to claim 8, wherein the club head is an iron-type golf club head.

* * * * *

UNITED STATES PATENT AND TRADEMARK OFFICE

CERTIFICATE OF CORRECTION

PATENT NO. : 7,604,549 B2
APPLICATION NO. : 11/320769
DATED : October 20, 2009
INVENTOR(S) : Yasushi Sugimoto It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 270 days.

Signed and Sealed this

Fifth Day of October, 2010

David J. Kappos

David J. Kappos
*Director of the United States Patent and Trademark Office*